US005830025A

United States Patent [19]

Fleming

[11] Patent Number: 5,830,025

[45] Date of Patent: Nov. 3, 1998

[54] FIN BOX FOR A WATER SPORTS BOARD AND METHOD OF INSTALLATION

[76] Inventor: Marc W. Fleming, 6309 Vista St., Long Beach, Calif. 90803

[21] Appl. No.: 929,944

[22] Filed: Sep. 15, 1997

[51] Int. Cl.[6] ..... A63C 15/05

[52] U.S. Cl. ..... 441/79; 114/140

[58] Field of Search ..... 441/79; 114/140, 114/141, 126, 127

[56] References Cited

U.S. PATENT DOCUMENTS

| | | | |
|---|---|---|---|
| 4,379,703 | 4/1983 | Mizell | 441/79 |
| 4,804,347 | 2/1989 | Ross | 441/79 |

*Primary Examiner*—Jesus D. Sotelo

*Attorney, Agent, or Firm*—Lyon & Lyon LLP

[57] ABSTRACT

A fin box for a water sports board including an elongate socket and a flange which extends laterally from the elongate socket. The socket includes a central elongate cavity and a raised lip about the cavity. The elongate socket also includes an oblong cylindrical outer surface. A ramp extends between the raised lip and the flange. The lip includes a surface to receive sealing tape employed for the laminating process. A set screw assembly provides for locking of a fin within the central elongate cavity. Gussets extending between the flange and the elongate socket provide dimensional stability and locational strength as well as serrations for easy insertion into the foam core of a water sports board. The fin box is able to accommodate positioning within a coating of resin in a socket in the foam core of a water sports board with laminating of the board occurring immediately. The cavity is then exposed through grinding.

13 Claims, 3 Drawing Sheets

FIN BOX FOR A WATER SPORTS BOARD AND METHOD OF INSTALLATION

BACKGROUND OF THE INVENTION

The field of the present invention is the fabrication of water sports boards including surfboards, wake boards, sail boards and the like.

Most water sports boards include one or more fins for stability and control. The boards themselves are frequently of a foam core with laminate such as fiberglass with a laminating resin covering and sealing the core. Typically the fiberglass or wooden fins have been added to the board after the board has been laminated. The fins are typically glued right to the surface of the board and then reinforcing fiberglass patches are laminated to the board and the sides of the fins for strength. Fiberglass roving is also positioned to either side of the fin to increase the radius of the fillets for added strength.

More recently, mountings have been positioned into the foam core and bonded to the board. Once the bonding is complete, laminate is positioned over the mount. A covering over the socket provided in the mount is then removed to provide an installation referred to as a fin box. A fin may then be positioned within the box to complete the assembly. One such system is illustrated in U.S. Pat. No. 4,804,347.

Fin boxes have typically proven to be problematic, both in assembly and during use. During assembly, the process of affixing the box to the core requires a delay during which the bond strengthens. Even after the box is in place, attention must be paid to cutting the fiberglass laminate material around the slot cover. The assembly procedure using such fin boxes becomes time consuming and difficult. During use, such boxes have been found to lack lateral strength.

SUMMARY OF THE INVENTION

The present invention is directed to a fin box for use on water sports boards and to the method of installation of such boxes.

In a first, separate aspect of the present invention, a fin box includes an elongate socket which has a central elongate cavity and an oblong cylindrical outer surface. A flange extends laterally from the elongate socket. A lip about the central elongate cavity is raised above the flange with a ramp extending from the flange to the lip. This structure accommodates fabrication by allowing the laminating of the entire board including the fin boxes without the necessity for fitting the laminate about the box cavities. The structure also provides substantial lateral strength, preventing fins from being bent over during use.

In a second, separate aspect of the present invention, the fin box of the first aspect further includes a set screw assembly located at one end of the elongate cavity so as to provide locking for an inserted fin. The location of the set screw allows for control over the locking force so that extraction force upon impact with an object may be regulated.

In a third, separate aspect of the present invention, a fin box includes an elongate socket having a central elongate cavity, a lip about the central elongate cavity and an oblong cylindrical outer surface. A flange extends outwardly from the socket with the lip raised from the surface of the flange. The lip further includes a surface which extends fully about the central elongate cavity. This surface makes possible the placement of sealing tape to cover the elongate cavity and, where appropriate, the set screw. The raised lip along with the surface available for sealing tape makes possible the grinding of the laminate surface to expose the central elongate cavity for receipt of a fin.

In a fourth, separate aspect of the present invention, a fin box having an elongate socket including a central elongate cavity and a flange extending laterally from the elongate socket further includes gussets having serrated distal edges. The gussets extend between the cylindrical outer surface of the elongate socket and the flange. The gussets provide strength to the flange, dimensional integrity to the overall box and increased placement strength within the foam core.

In a fifth, separate aspect of the present invention, a method of installation of a fin box contemplates the machining of a first and second groove, coating the grooves with resin and positioning the fin box in the cavity formed. The water sports board is then laminated without waiting for the resin coating the grooves to cure. Finally, the laminate is machined away to expose the fin box. In this procedure, delay is not encountered while bonding of the fin box into the foam core takes place.

Accordingly, it is an object of the present invention to provide an improved fin box structure and method of installation for water sports boards. Other and further objects and advantages will appear hereinafter.

DETAILED DESCRIPTION OF THE PREFERRED EMBODIMENT

Figure 1:
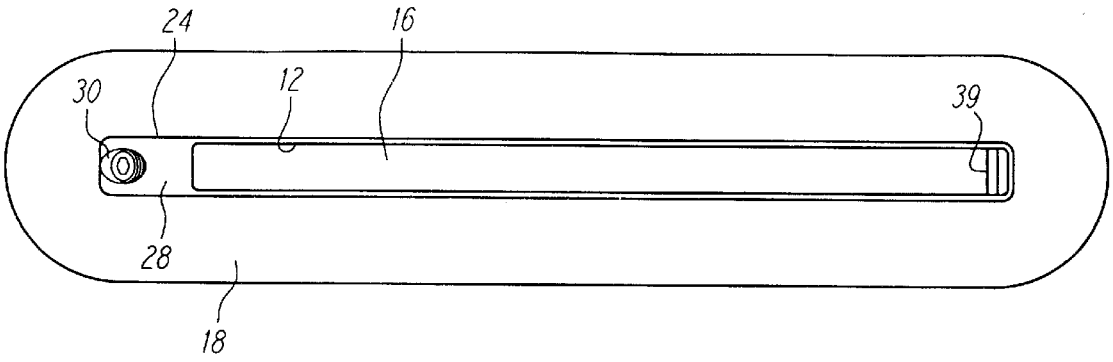
FIG. 1 is a plan view of a fin box.
Figure 2:
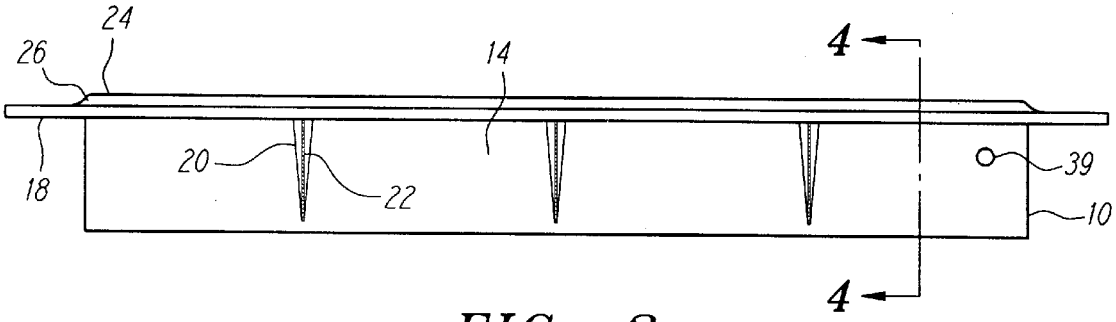
FIG. 2 is a side view of the fin box.
Figure 3:
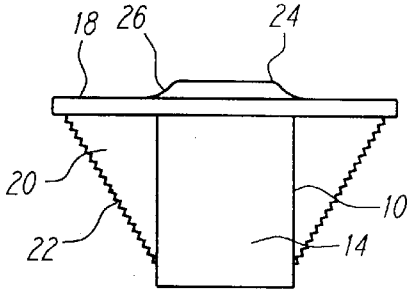
FIG. 3 is an end view of the fin box.
Figure 4:
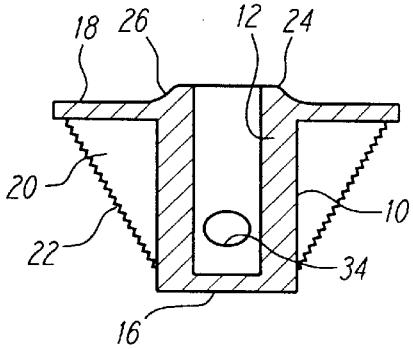
FIG. 4 is a cross-sectional end view taken along line 4—4 of FIG. 2.
Figure 5:
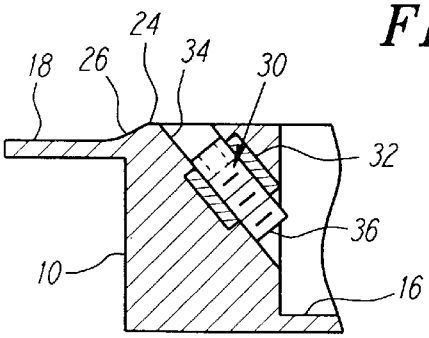
FIG. 5 is a detail cross-sectional side view illustrating the set screw assembly.
Figure 6:
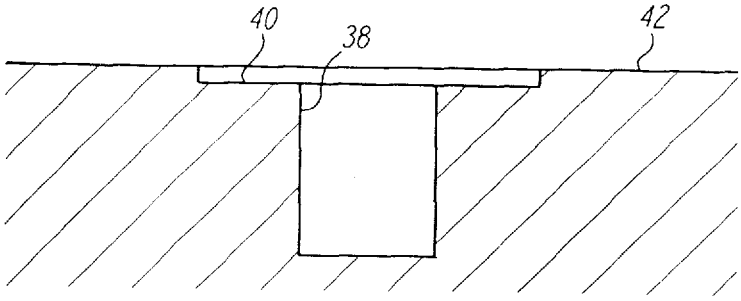
FIG. 6 is a water sports board foam core with superimposed routed slots.
Figure 7:
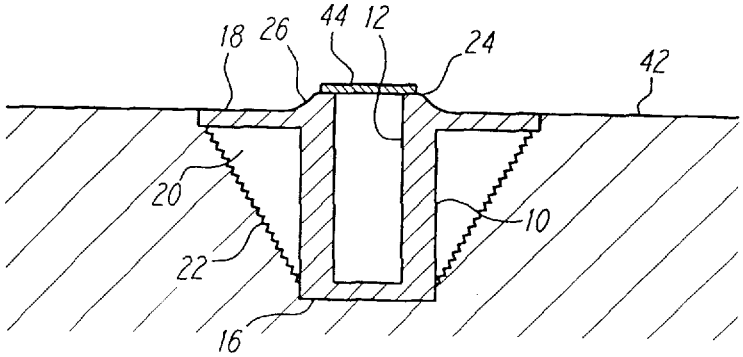
FIG. 7 is a cross-sectional end view of the foam core with a fin box positioned within the superimposed routed slots.
Figure 8:
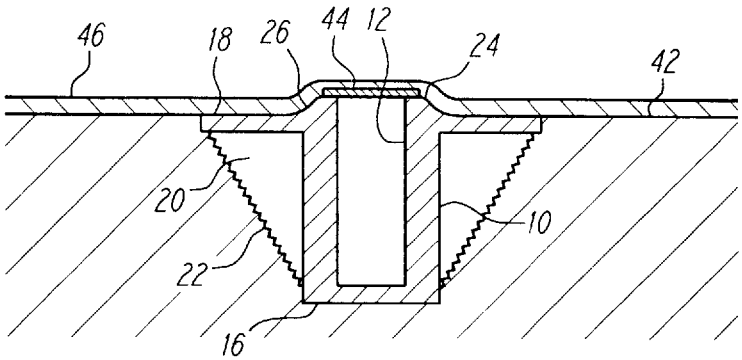
FIG. 8 is a cross-sectional view of FIG. 7 with laminate added over the foam core and the fin box.
Figure 9:
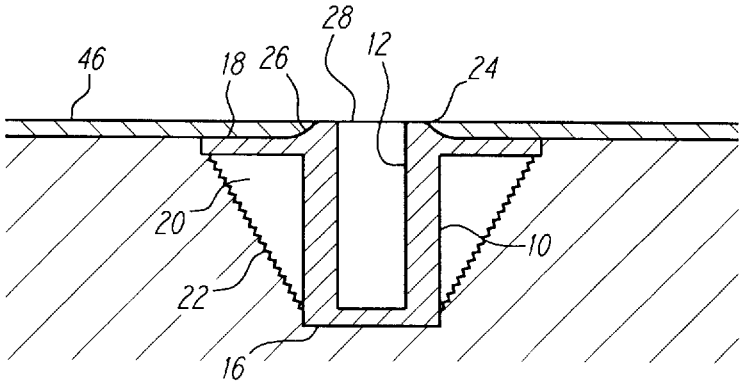
FIG. 9 is a cross section of the assembly of FIG. 8 with the elongate cavity of the fin box exposed through grinding of the laminate.

Turning in detail to the drawings, a fin box for a water sports board is illustrated in FIGS. 1 through 5. In FIGS. 6 through 9, the process for the installation of the fin box in a water sports board is emphasized. The fin box is to be employed with fins (not shown) which include a base that closely fits within the elongate cavity of the fin box. A fin is integrally formed with the base which may take on any desired configuration. The fin may be smaller, the same size or even larger than the base at its point of intersection with the base.

The fin box includes an elongate socket 10. The elongate socket includes a central elongate cavity 12. The elongate cavity 12 is shown in the preferred embodiment to have a substantially rectangular cross section with small fillets at the corners. The elongate socket 10 has an oblong cylindrical outer surface 14. Two straight parallel sides are connected by semicircular sections. The term "cylindrical" is used in the mathematical sense as including more than circular cylinders. The sides of the oblong cylindrical outer surface 14 are not beveled. Consequently, rotation of the fin box within the water sports board is resisted by the surfaces. Naturally, some slight angle does not significantly detract from this property and is contemplated within the use of this term. The socket 10 further includes a bottom 16.

A flange 18 extends laterally from the elongate socket. The flange 18 is of a uniform width extending outwardly from the cylindrical outer surface 14 such that it also forms an oblong pattern where the peripheral edge is displaced from the oblong cylindrical surface 14 at a uniform normal distance. This arrangement is advantageous for one-step routing of a water sports board core.

Extending between the oblong cylindrical outer surface 14 and the flange 18 are gussets 20. The gussets may be of any convenient shape and are illustrated in the preferred embodiment to be triangular. The gussets 20 each have a distal edge 22 which is serrated to assist in insertion into a foam core cavity. The gussets assist both in dimensional stability and in longitudinal retention of the box in the water sports board.

Extending upwardly as part of the elongate socket 10 is a lip 24. As seen in the Figures, the lip 58 is raised from the flat upper surface portion of the flange 18. Transitioning between the lip 24 and the upper surface of the flange 24 is a ramp 26. The ramp 26 is concave. The height of the lip 24 above the flat surface of the flange 18 depends upon the completed thickness of the laminate as will be established below.

The lip 24 has a surface 28 extending outwardly from the central elongate cavity 12. The surface 28 is preferably flat to receive sealing tape as discussed below. The surface 28 also includes a wider section at one end to accommodate a set screw assembly.

The set screw assembly 30 is positioned at one end of the elongate cavity 12 and includes an insert 32 defining at least a portion of a passage 34 which extends diagonally from the surface 28 of the lip 24 to the central elongate cavity 12. A set screw 36 is threadably positioned within the passage 34 such that it can be advanced in the cavity to lock the base of the fin located therein. By placing the set screw 36 on the end of the central elongate cavity 12, one is able to exercise a certain level of control over forced extraction of the fin. By severely tightening the set screw 36, very high extraction forces would be required. These forces may exceed the pull out force on the box itself. Lesser tightening may result in less force required for extraction.

An optional pin 39 may be arranged across the socket 10 at the end of the central elongate cavity away from the set screw assembly 30. The pin 39 is employed when it is desired that the fin not pull out of the box. With the pin 39, a fin is contemplated with a rectilinear base just fitting within the elongate cavity 12. A groove is cut in the back end of the fin base to receive the pin 39. A notch is positioned at the other end of the base to provide a surface normal to the axis of the set screw 36.

To employ the fin box, superimposed slots 38 and 40 are cut into a foam core 42 of a water sports board. The slots 38 and 40 may be cut at the same time by a router such that a thinner, deeper slot 38 and a wider, shallower slot 40 are machined to be axially aligned. Using a single router, the flange 18 naturally ends up with a uniform width. Once the machining is complete, a thin coating of resin is applied to the slots. The resin is preferably the liquid material which is used in the laminating of the skin of the water sports board and has accelerator such that it will cure.

The fin box is then pressed into the slots 38 and 40. The serrated distal edges 22 of the gussets 20 cut through the foam core 42. The slots 38 and 40 are designed to be a close fit with the fin box elongate socket 10 and flange 18. The upper surface of the flange is preferably flush with the surface of the foam core 42.

Either before or after assembling the fin box with the foam core 42, sealing tape 44 is positioned on the fin box to cover the central elongate cavity 12. The sealing tape 44 adheres to the surface 28 of the lip 24. This tape is preferably die cut for accuracy and provides the appropriate adherence to survive the remaining operations.

With the fin box and tape 44 in place, laminate 46 is installed over the foam core 42 as well as over the fin box and the tape 44. The coating of the slots 38 and 40, the placement of the fin box and covering with the laminate 46 may all occur as part of the same continuous process. Because of the arrangement of the fin box, there is no need to securely bond the box into the foam core prior to continuing with the process. The laminate 46 is typically a composition of fiberglass cloth and resin. The laminate is allowed to cure as extended over the fin box. Once hardened, a grinding process may be used to remove the laminate which sticks up over the lip on the water sports board as well as the tape which is underneath. This exposes the central elongate cavity for receipt of a fin. The fin of course may be locked in place by the set screw 36.

Accordingly, a fin box is disclosed which may be easily integrated into the water sports board assembly process and which provides substantial strength when in place. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A fin box for a water sports board, comprising an elongate socket including a central elongate cavity, a lip about the central elongate cavity and an oblong cylindrical outer surface;

a flange extending laterally from the elongate socket and including a substantially flat upper surface portion, the lip being raised from the flat upper surface portion, and a ramp portion extending between the flat upper surface portion and the lip.

2. The fin box of claim 1, the ramp being concave.

3. The fin box of claim 1, the flange and the ramp extending fully about the elongate socket.

4. The fin box of claim 1, the central elongate cavity being substantially rectangular, the oblong cylindrical outer surface including parallel sides and semi-circular ends.

5. The fin box of claim 4, the laterally extending flange including a peripheral edge displaced from the oblong cylindrical outer surface at a uniform normal distance.

6. The fin box of claim 1, the central elongate cavity having a bottom surface defined by the elongate socket.

7. A fin box for a water sports board, comprising an elongate socket including a central elongate cavity, a lip about the central elongate cavity and an oblong cylindrical outer surface, the lip having a surface extending outwardly from the central elongate cavity fully about the central elongate cavity;

a flange extending laterally from the elongate socket, the lip being raised from the flange, the flange including a ramp sloping from the lip surface to the flange, the flange and the ramp extending fully about the elongate socket.

8. The fin box of claim 7, the ramp being concave.

9. The fin box of claim 7 further comprising a set screw assembly including a passage extending from the lip to one end of the central elongate cavity at a diagonal to the central elongate cavity, the passage including internal threads, and a set screw threadably engaged with the passage.

10. A fin box for a water sports board, comprising an elongate socket including a central elongate cavity, a lip about the central elongate cavity and an oblong cylindrical outer surface;

a flange extending laterally from the elongate socket, the lip being raised from the flange, the flange including a ramp sloping from the lip to the flange;

a set screw at one end of the elongate socket capable of extending diagonally into one end of the central elongate cavity.

11. The fin box of claim 10 further comprising a pin extending across the elongate socket at the other end of the elongate socket.

12. A fin box for a water sports board, comprising an elongate socket including a central elongate cavity, a lip about the central elongate cavity and an oblong cylindrical outer surface;

a flange extending laterally from the elongate socket, the lip being raised from the flange, the flange including a ramp sloping from the lip to the flange;

gussets having serrated distal edges extending between the cylindrical outer surface and the flange.

13. A method for installing a fin box in a water sports board having a fin box cavity, comprising machining a first elongate groove and a second, wider and shallower elongate groove axially aligned with the first elongate groove in a water sports board;

coating the grooves with resin;

covering the fin box cavity;

press fitting the fin box in the grooves after coating the grooves;

laminating the water sports board over the fin box press fit in the grooves without waiting for the resin coating the grooves to cure;

grinding through the laminate to the fin box cavity.

* * * * *